US007452221B1

(12) United States Patent
Oddsen et al.

(10) Patent No.: US 7,452,221 B1
(45) Date of Patent: Nov. 18, 2008

(54) TAMPER RESISTANT ASSEMBLY FOR AN ELECTRICAL RECEPTACLE

(75) Inventors: Dennis A. Oddsen, Northport, NY (US); Michael J. Marchetti, Bridgeport, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 12/073,695

(22) Filed: Mar. 7, 2008

(51) Int. Cl.
*H01R 13/44* (2006.01)

(52) U.S. Cl. ..... 439/137; 439/140

(58) Field of Classification Search ..... 439/137, 439/136, 140, 145
See application file for complete search history.

(56) References Cited

U.S. PATENT DOCUMENTS

| | | | | |
|---|---|---|---|---|
| 2,553,837 | A | 5/1951 | Holtz | |
| 3,601,758 | A | 8/1971 | Davidsson | |
| 3,980,372 | A | 9/1976 | Ranzanigo | |
| 4,206,957 | A | 6/1980 | Ludwig | |
| 4,632,479 | A | 12/1986 | Jacobson | |
| 4,707,042 | A | 11/1987 | Haden | |
| 4,722,693 | A * | 2/1988 | Rose | 439/137 |
| 5,006,075 | A | 4/1991 | Bowden | |
| 5,020,997 | A * | 6/1991 | Calderara et al. | 439/137 |
| 5,068,601 | A | 11/1991 | Parmenter | |
| 5,069,630 | A | 12/1991 | Tseng | |
| 5,391,085 | A | 2/1995 | Tigner | |
| 6,015,306 | A | 1/2000 | Jen | |
| 6,086,391 | A * | 7/2000 | Chiu | 439/145 |
| 6,224,401 | B1 | 5/2001 | Yu | |
| 6,537,089 | B1 | 3/2003 | Montague | |
| 6,555,771 | B2 * | 4/2003 | Shao | 200/51 R |
| 6,776,630 | B1 * | 8/2004 | Huang | 439/137 |
| 6,786,745 | B1 * | 9/2004 | Huang | 439/137 |
| 6,893,275 | B2 * | 5/2005 | Ng et al. | 439/137 |
| 6,932,631 | B2 * | 8/2005 | Huang | 439/145 |
| 6,969,801 | B2 | 11/2005 | Radosavljevic | |
| 7,179,992 | B1 | 2/2007 | Packard | |

(Continued)

FOREIGN PATENT DOCUMENTS

JP 2006040733 2/2006

*Primary Examiner*—T C Patel
*Assistant Examiner*—Harshad C Patel
(74) *Attorney, Agent, or Firm*—Marcus R. Mickney; Mark S. Bicks; Alfred N. Goodman

(57) ABSTRACT

A tamper resistant assembly provides tamper resistance to an electrical receptacle. The tamper resistant assembly includes a base member having first and second grooves. Each groove has a first portion and a second portion connected to the first portion. The first portion is substantially perpendicular to a rear wall of the member and the second portion forms an angle with the first portion. A shutter member is slidably and pivotally connected to the base member for movement between open and closed positions. First and second protrusions extend outwardly from the shutter member and are slidably and pivotally received in the first and second grooves, respectively, in the base member. The first and second protrusions are disposed in the first portions of the grooves when the shutter member is in the closed position and prevent lateral sliding movement of the shutter member to prevent insertion of a foreign object past the shutter member, and in the second portions when the shutter member is in the open position by allowing lateral sliding of the shutter member. The first portions prevent lateral movement of the shutter member and allow pivoting movement of the shutter member to positions preventing insertion of a foreign object past the shutter member.

20 Claims, 10 Drawing Sheets

U.S. PATENT DOCUMENTS

| | | | | |
|---|---|---|---|---|
| 7,211,729 | B1 * | 5/2007 | Yang | 174/66 |
| 7,355,117 | B2 * | 4/2008 | Castaldo et al. | 174/53 |
| 2003/0017731 | A1 * | 1/2003 | Huang | 439/137 |
| 2005/0026482 | A1 * | 2/2005 | Huang | 439/145 |
| 2007/0114053 | A1 | 5/2007 | Castaldo | |

* cited by examiner

FIG. 5
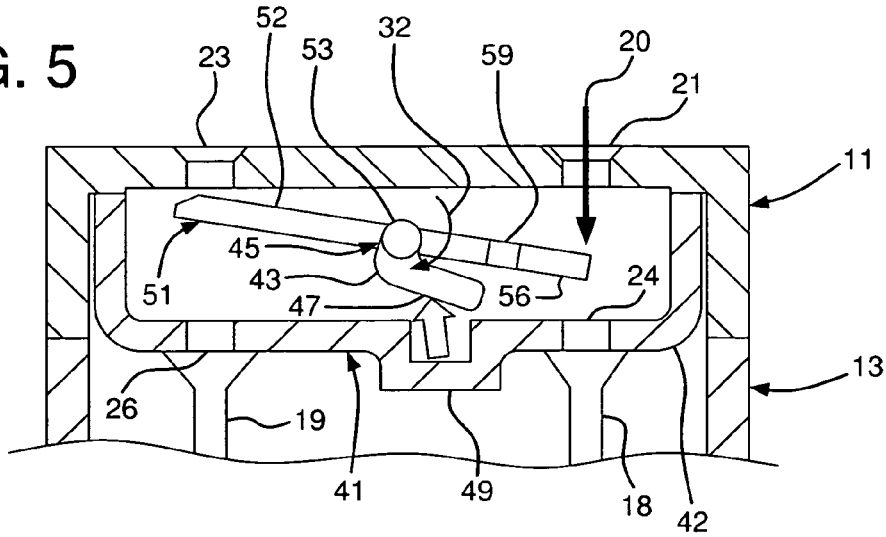
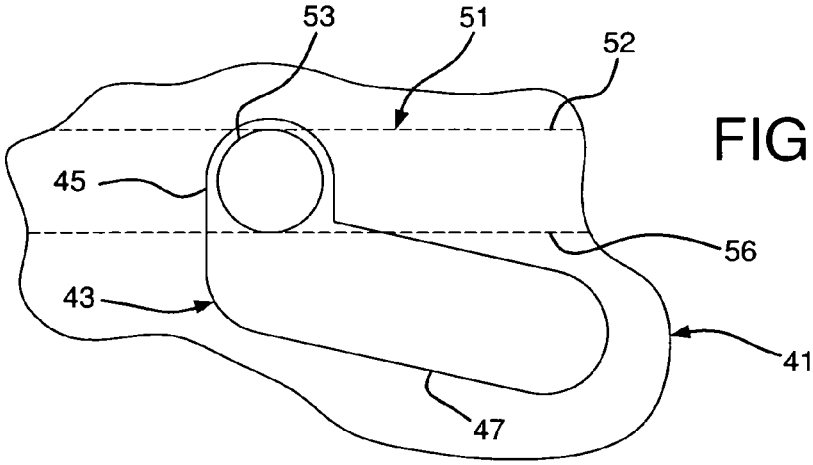
FIG. 6
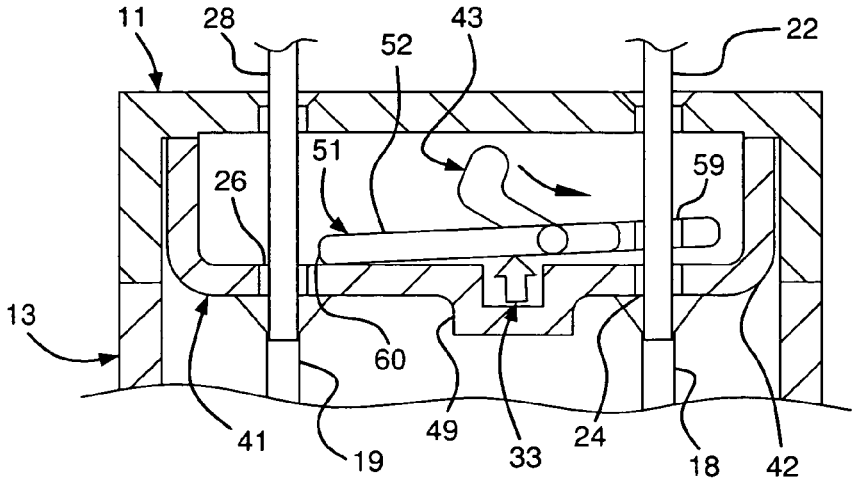
FIG. 7

TAMPER RESISTANT ASSEMBLY FOR AN ELECTRICAL RECEPTACLE

FIELD OF THE INVENTION

The present invention relates to a tamper resistant assembly for an electrical receptacle. More particularly, the present invention relates to a tamper resistant electrical receptacle having a shutter member that is movable in two dimensions. Still more particularly, the present invention relates to a tamper resistant assembly for an electrical receptacle in which the base member of the tamper resistant assembly has a groove for receiving a protrusion of a shutter member to prevent accidental movement of the shutter member and in which a second portion of the groove is connected to and forms an angle with a first portion of the groove.

BACKGROUND OF THE INVENTION

A group of electrical receptacles is referred to as "protective" receptacles because some measure has been taken in the construction to protect children and others from harm if they should intentionally or inadvertently insert or attempt to insert an electrically conductive article into the electrically energized portions of the receptacle. Conventional electrical receptacles have a nonconductive face portion with openings to receive plug blades. In normal use, the blades pass through the nonconductive space and are received by conductive female elements that are connected to line voltage. A child inserting, for example, a paper clip or the conductive portion of a toy into the energized conductive elements can be seriously injured.

To avoid this danger, "shuttered" receptacles resist insertion and electrical connection of anything other than the blades of an appropriate plug by elements provided between the faceplate and the conductive elements. The electrical energization of internal components is not controlled; rather, access to those conductive elements is prevented except under a defined set of circumstances.

An example of a shuttered receptacle is found in U.S. Pat. No. 4,379,607 to Bowden, Jr. (the Bowden '607 patent), the subject matter of which is hereby incorporated by reference. The Bowden '607 patent discloses two identical slideable shutter members 56 provided behind the slots 70 in the cover 54 and in front of the terminals 68 within the receptacle base 52, as shown in FIGS. 1, 2 and 7. Each of the two identical shutter members has a cam surface 108 and a blocking portion 106. The cam surfaces 108 are positioned so that each one is contacted by a blade and is caused to move so that its blocking portion unblocks the slot for the other blade. Thus, when the two blades are concurrently inserted, they act against the two cam surfaces and unblock each other's passageways.

However, the Bowden '607 patent requires two shutter members to properly provide tamper resistance to the electrical receptacle. Thus, a need exists for an improved tamper resistant assembly in which one shutter member provides tamper resistance for an electrical receptacle, thereby reducing inventory and costs.

Furthermore, a shutter member that is limited to linear motion is resistant to actuation upon insertion of a plug blade. Therefore, a need exists for a shutter member that moves in two dimensions to increase the responsiveness of the shutter member to inserted plug blades, thereby providing a more efficient tamper resistant assembly.

Thus, there is a continuing need to provide improved tamper resistant assemblies for electrical receptacles.

SUMMARY OF THE INVENTION

Accordingly, it is a primary objective of the present invention to provide an improved tamper resistant assembly for an electrical receptacle.

A further objective of the present invention is to provide an improved tamper resistant assembly having a reduced number of parts.

A still further objective of the present invention is to provide an improved tamper resistant receptacle having a shutter member that is movable in two dimensions.

The foregoing objectives are basically attained by a tamper resistant assembly including a base member having first and second grooves. Each groove has a first portion and a second portion connected to the first portion. The first portion is substantially perpendicular to a rear wall of the member and the second portion forms an obtuse angle with the first portion. A shutter member is slidably and pivotally connected to the base member for movement between open and closed positions. First and second protrusions extend outwardly from the shutter member and are slidably and pivotally received in the first and second grooves, respectively, in the base member. The first and second protrusions are disposed in the first portions of the grooves when the shutter member is in the closed position and prevent lateral sliding of the shutter member to prevent insertion of a foreign object past the shutter member and in the second portions when the shutter member is in the open position by allowing lateral sliding of the shutter member. The first portions prevent lateral movement of the shutter member and allow pivoting movement of the shutter member to positions preventing insertion of the foreign object past the shutter member.

The foregoing objectives are also basically attained by an electrical receptacle having a tamper resistant assembly disposed therein. The electrical receptacle includes a front cover and a back housing secured to the front cover. A tamper resistant assembly is disposed between the front cover and the back housing. A base member has first and second side walls extending forwardly from a rear wall. First and second grooves are formed in the first side wall of the base member and third and fourth grooves are formed in the second side wall. Each groove has a first portion and a second portion connected to the first portion. The first portion is substantially perpendicular to the rear wall of the base member and the second portion forms an obtuse angle with the first portion. A shutter member is slidably and pivotally connected to the base member for movement between open and closed positions. First and second protrusions extend outwardly from the shutter member and are slidably and pivotally received in the first and second grooves in the base member and third and fourth protrusions extend outwardly from the shutter member and are slidably and pivotally received in the third and fourth grooves. The protrusions are disposed in the first portions of the grooves when the shutter member is in the closed position and prevent lateral sliding of the shutter member to prevent insertion of a foreign object past the shutter member and in the second portions when the shutter member is in the open position by allowing lateral sliding of the shutter member. The first portions prevent lateral movement of the shutter member and allow pivoting movement of the shutter member to positions preventing insertion of the foreign object past the shutter member.

Other objects, advantages and salient features of the invention will become apparent from the following detailed description, which, taken in conjunction with the annexed drawings, discloses a preferred embodiment of the invention.

As used in this application, the terms "front," "rear," "outwardly," "upwardly" and "downwardly" are intended to facilitate the description of the tamper resistant electrical receptacle, and are not intended to limit the structure of the tamper resistant electrical receptacle to any particular position or orientation.

BRIEF DESCRIPTION OF THE DRAWINGS

The above aspects and features of the present invention will be more apparent from the description for exemplary embodiments of the present invention taken with reference to the accompanying drawings, in which:

FIGS. 4 and 5 are end elevational views in cross section of the tamper resistant assembly of FIG. 2 disposed in an electrical receptacle and blocking access to an electrical contact;

FIG. 6 is an enlarged end elevational view of a protrusion of a shutter member received in a groove of the base member of the tamper resistant assembly of FIG. 2;

FIG. 7 is an end elevational view in cross section of the tamper resistant assembly of FIG. 2 disposed in an electrical receptacle and allowing access to electrical contacts;

DETAILED DESCRIPTION OF THE INVENTION

As shown in FIGS. 1-15, the present invention includes a tamper resistant electrical receptacle 10 having a tamper resistant assembly 31 that provides tamper resistance for the electrical receptacle 10.

Figure 2:
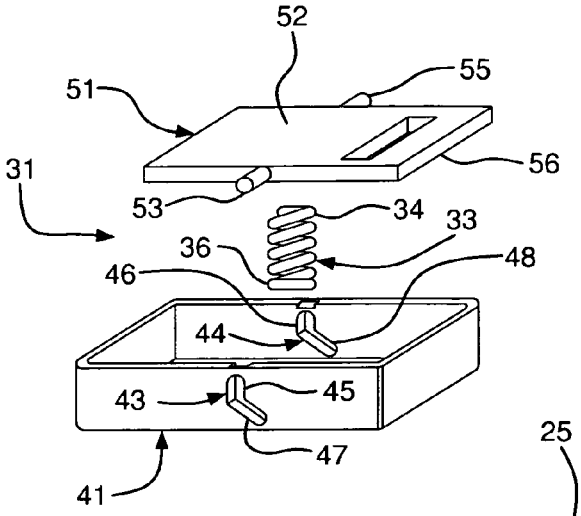
FIG. 2 is an exploded perspective view of a tamper resistant assembly according to a first exemplary embodiment of the present invention.
Figure 3:
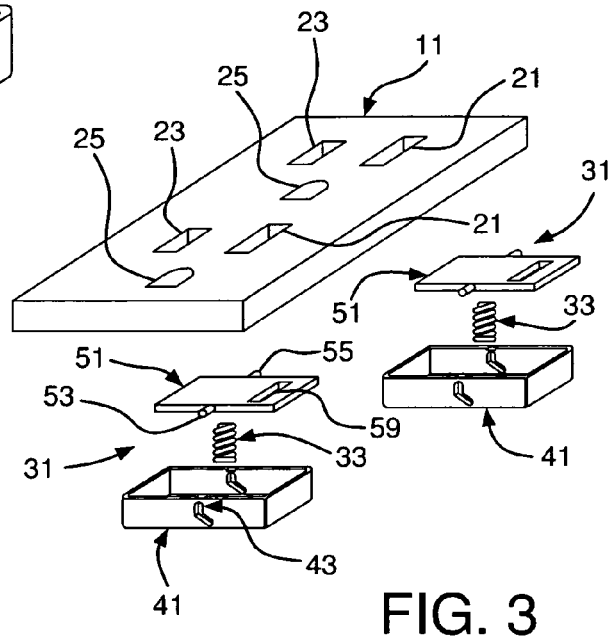
FIG. 3 is an exploded perspective view of the tamper resistant assembly of FIG. 2 and a front cover of an electrical receptacle.
Figure 4:
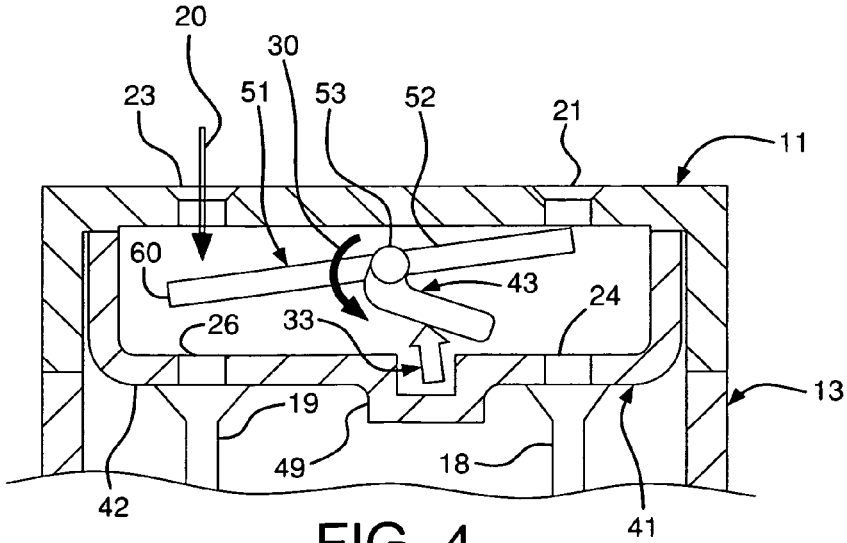

The tamper resistant assembly 31 according to a first exemplary embodiment, as shown in FIGS. 2-7, includes a base member 41, a shutter member 51 and a spring 33. A first groove 43 is formed in the base member 41 and has a first portion 45 and a second portion 47 connected to and forming an angle α (FIG. 8) with the first portion. A second groove 44 is formed in the base member 41 and has a first portion 46 and a second portion 48 connected to and forming an angle α (FIG. 8) with the first portion. Preferably, the angle α is approximately 52 degrees, providing an included obtuse angle of approximately 128 degrees. A shutter member 51 is slidably connected to the base member 41. First and second protrusions 53 and 55 extend outwardly from the shutter member 51 and are movably received in the first and second grooves 43 and 44, respectively, in the base member 41, as shown in FIGS. 4-7. The first and second protrusions 53 and 55 are disposed in the first portions 45 and 46 of the first and second grooves 43 and 44, respectively, when the shutter member 61 is in a closed position, as shown in FIGS. 4 and 5. The first and second protrusions 53 and 55 are disposed in the second portions 47 and 48 of the first and second grooves 43 and 44, respectively, when the shutter member 51 is in an open position, as shown in FIG. 7. The first portions 45 and 46 of the first and second grooves 43 and 44 prevent movement of the first and second protrusions 53 and 55 into the second portions 45 and 46 to resist insertion of a foreign object past the shutter member 51. Alternatively, as shown in FIGS. 8-14, the base member may have six grooves (three on each of two opposite sides) and the shutter member may have six protrusions (three on each of two opposite sides).

Figure 1:
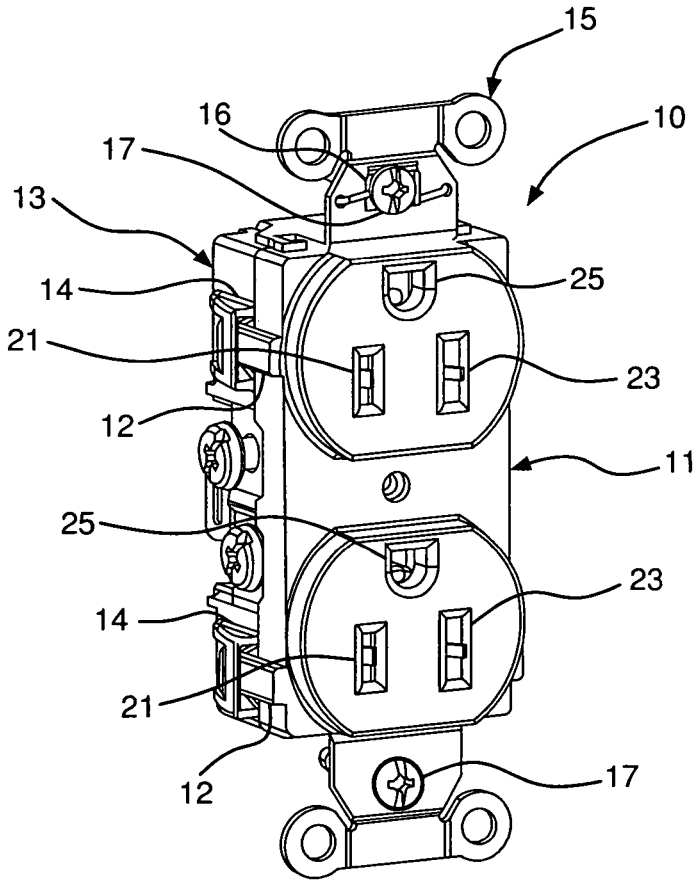
FIG. 1 is a perspective view of an assembled electrical receptacle including a tamper resistant assembly according to an exemplary embodiment of the present invention.

The electrical receptacle 10 has a front cover 11 connected to a back housing 13 with a ground strap 15 connected thereto, as shown in FIG. 1. The ground strap 15 has openings 16 disposed at opposite ends adapted to receive fasteners 17 to connect the electrical receptacle 10 to an electrical box (not shown). The ground strap 15 may extend around a rear surface of the back housing 15 as shown in FIG. 1, or may, alternatively, be disposed between the front cover 11 and the back housing 13. A plurality of arms 12 extend rearwardly from the front cover 11 and are received by receptacles 14 of the back housing 13 to connect the front cover to the back housing. Conductive elements 18 and 19 are disposed within the back housing 13 to receive and make electrical contact with inserted blades 22 and 28 of an electrical plug, as shown in FIG. 7.

The front cover 11 has openings suitably disposed to receive the ground prong and hot and neutral blades of a conventional male plug. The electrical receptacle shown in FIGS. 1 and 4-10 is a duplex electrical receptacle, although the present invention is not limited thereto. A first opening 21 and a second opening 23 are disposed in the front cover 11 to receive the hot and neutral blades that form part of the power circuit for the appliance being connected thereto. A third opening 25 receives the ground prong of a grounded three-prong connector. The first and second openings 21 and 23 are substantially rectangular in shape and substantially parallel to one another. A plug in which the two blades 22 and 28 passing through the first and second openings 21 and 23 are substantially parallel is referred to as a parallel blade plug, such as a 15 amp plug. The ground prong is typically substantially D-shaped in transverse cross-section, and is generally longer than the blades passing through the first and second openings 21 and 23. However, the shutter assembly shown and described does not interfere with the presence of such a grounding plug.

First and second openings 24 and 26 in the back housing 13 are aligned with first and second openings 21 and 23, respectively, in the front cover 11, as shown in FIG. 7. Electrical contacts 18 and 19 are aligned with the first and second openings 24 and 26 in the back housing, thereby being accessible with plug blades 22 and 28 properly inserted in the front cover 11, as shown in FIG. 7.

In the exploded view of FIGS. 2 and 3, the shutter member 51 has an upper surface 52 that is substantially planar and faces toward the first and second openings 21 and 23 in the front cover 11 of the electrical receptacle 10 through which plug blades are inserted. The upper surface 52 is positioned below the first and second openings 21 and 23 to resist a foreign object or a single plug blade inserted therethrough from contacting the electrical contacts 18 and 19.

First and second protrusions 53 and 55 extend laterally outwardly from the shutter member 51. Preferably, the first and second protrusions 53 and 55 are circular and cylindrical. The first protrusion is received in the first groove 43 in the base member 41 and the second protrusion is received in the second groove 45 in the base member. The first and second protrusions 53 and 55 extend in substantially opposite directions from opposite sides of the shutter member 51. An opening 59 in the shutter member 51 allows a plug blade 22 to pass therethrough, as shown in FIG. 7. Alternatively, as shown in FIGS. 10-14, the shutter member may have two openings such that each opening receives a plug blade.

Figure 8:
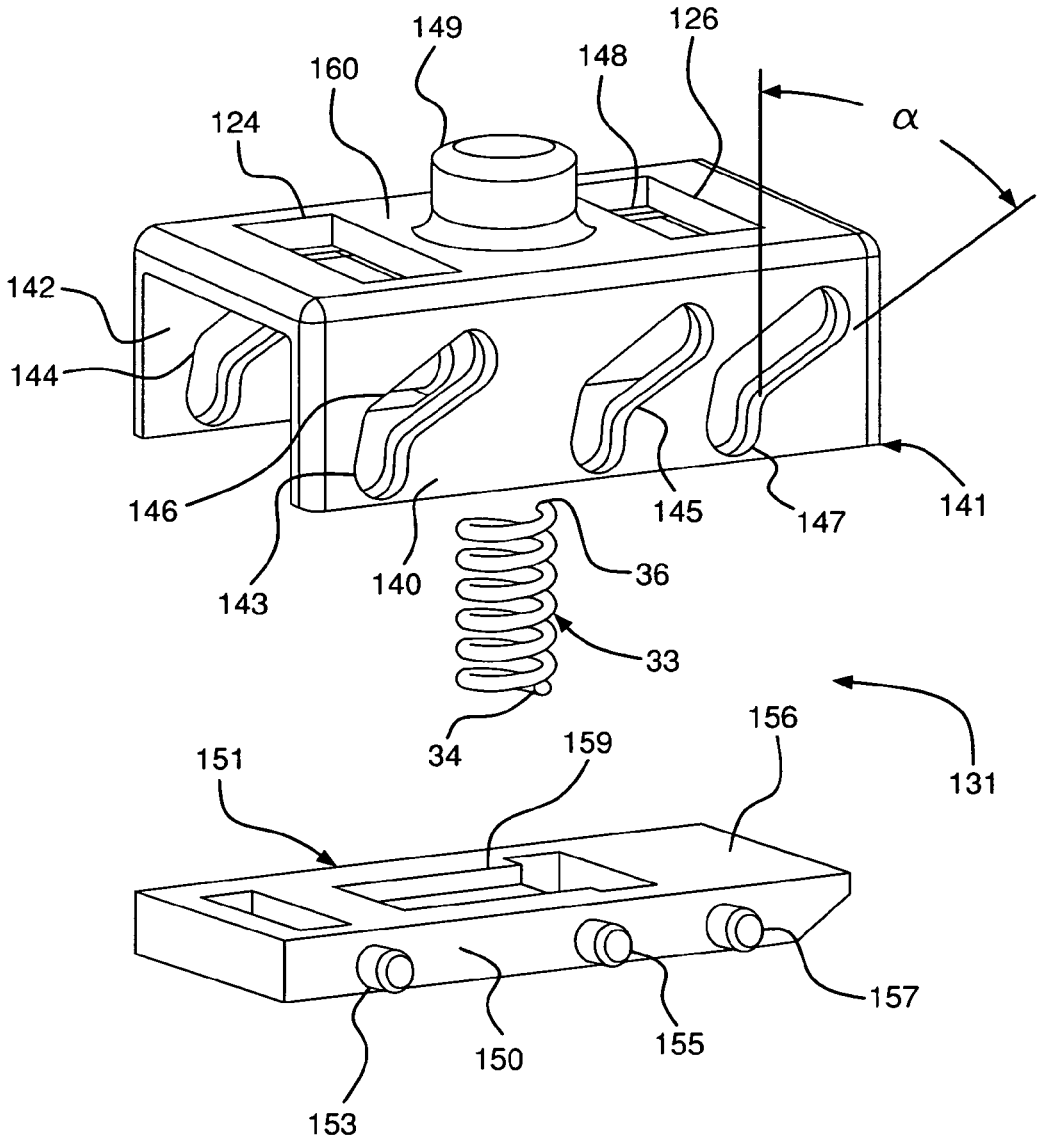
FIG. 8 is an exploded perspective view of a tamper resistant assembly according to a second exemplary embodiment of the present invention.

The spring 33 urges the shutter member 51 towards its normal, relaxed position away from the rear wall 42 of the base member 41 when no plug blades are present. A first end 34 of the spring 33 is connected to a rear surface 56 of the shutter member 51. A second end 36 of the spring 33 is connected to the rear wall 42 of the base member 41. A recess 49 may be disposed in the base member 41 to receive the second end 36 of the spring 33. Preferably, a recess is formed in the rear surface of the shutter member 51 to receive the first end 34 of the spring 33, as shown in FIG. 8. Although a coil spring is shown, any suitable spring may be used, such as a flat metal spring.

Referring to FIGS. 4 and 5, the upper surface 52 is disposed adjacent the first and second openings 21 and 23 such that an object inserted therein contacts the upper surface 52 of the shutter member 51, thereby pivoting the shutter member 51 about the first and second protrusions.

The shutter assembly 31 is shown assembled in FIGS. 4, 5 and 7. The first protrusion 53 is received in the first groove 43 and the second protrusion 55 is received in the second groove 44. The spring 33 biases the shutter member 51 toward the front cover 11 such that the supper surface 52 blocks the first and second openings 21 and 23 in the front cover, as shown in FIGS. 4 and 5.

The base member 41 and the shutter member 51 are preferably made of a thermoplastic, such as Delrin® (Dupont), Duracon (Polyplastics Co., Ltd.) or nylon.

Assembly and Operation

The tamper resistant assembly 31 is assembled by disposing the first and second protrusions 53 and 55 in the first and second grooves 43 and 44, respectively, in the base member 41. The spring 31 is then disposed between the shutter member 51 and the base member 41. The first end 34 of the spring 33 is connected to the shutter member 51 and the second end 36 of the spring 33 is connected to the base member 41. This tamper resistant assembly 31, as shown in FIGS. 2 and 3, is then disposed in the front cover 11 or the back housing 13. Preferably, a snap fit is formed between the tamper resistant assembly 31 and the front cover 11 or back housing 13. As shown in FIG. 3, a duplex electrical receptacle 10 may receive two tamper resistant assemblies 31.

The electrical receptacle 10 includes the front cover 11 having the first opening 21 therein adapted to receive a first plug blade 22 of a plug and a second opening 23 adapted to receive a second plug blade 28 lying in a plane substantially parallel to the plane containing the plug blade 22 passing through the first opening 21, as shown in FIG. 7.

As plug blades 22 and 28 are inserted through first and second openings 21 and 23, respectively, as shown in FIG. 7, the blades 22 and 28 contact the upper surface 52 of the shutter member 51. As the plug blades 22 and 28 contact the upper surface 52, the shutter member 51 is moved such that the opening 59 in the shutter member 51 is aligned with the first opening 24 in the base member 41. The pressure exerted on the opposite ends of the shutter member 51 causes the protrusions 51 and 53 to move from the first portions 45 and 46 of the grooves 43 and 44 to the second portions 47 and 48, thereby moving the shutter member 51 downwardly and laterally to an open position in which the plug blades 22 and 28 may access the electrical contacts 18 and 19. Thus, the shutter member 51 moves in two dimensions when moving from the closed to the open position. In the open position, the opening 59 in the shutter member 51 is aligned with the opening 24 in the base member 41 to provide access to the electrical contact 18, and the rear end 60 of the shutter member unblocks a path between the second opening 23 in the front cover 11 and the second opening 26 in the base member 41 to provide access to the electrical contact 19. Upon removal of the plug blades 22 and 28, the spring 33 causes the protrusions to move upwardly and laterally through the grooves 43 and 44 to the first portions thereof, thereby returning the shutter member 51 to the closed position.

However, insertion of a foreign object 20, such as a single blade-like article, in either the first or second openings 21 and 23 is prevented from accessing the conductive elements 18 and 19 by the tamper resistant assembly 31, as shown in FIGS. 4 and 5. For example, as shown in FIG. 4, an object 20 inserted in the second opening 23 in the front cover 11 engages the upper surface 52 of the shutter member 51 spaced from rear end 60, thereby rotating the shutter member 51 in the direction indicated by arrow 30 such that the shutter member 51 remains in the closed position and access to the electrical contacts 18 and 19 is blocked. The shutter member 51 pivots about the first and second protrusions 53 and 55 disposed in the first portions 45 and 46 of the first and second grooves 43 and 44 in the base member 41. The counterclockwise rotation of the shutter member 51 causes slight upward movement of the protrusions 53 and 55 in the first portions 45 and 46 such that the walls forming the first portions prevent movement of the protrusions into the second portions 47 and 48 of the grooves 43 and 44 and prevent lateral movement of shutter member 51.

Similarly, the foreign object 20 is also prevented from accessing the conductive element 18 when inserted in the first opening 21 in the front cover 11, as shown in FIG. 5. The object 20 inserted in the first opening 21 engages the upper surface 52 of the shutter member 51 spaced from opening 59, thereby rotating the shutter member 51 in the direction indicated by arrow 32 such that the shutter member 51 remains in the closed position and access to the electrical contacts 18 and 19 is blocked. The shutter member 51 pivots about the first and second protrusions 53 and 55 disposed in the first portions 45 and 46 of the first and second grooves 43 and 44 in the base member 41. The clockwise rotation is substantially opposite to the rotation caused by insertion of the object 20 in the second opening 23, as shown in FIG. 4. The rotation of the shutter member 51 causes slight upward movement of the protrusions 53 and 55 in the first portions 45 and 46 such that the walls forming the first portions prevent movement of the protrusions into the second portions 47 and 48 of the grooves 43 and 44 and prevent lateral movement of shutter member 51.

SECOND EXEMPLARY EMBODIMENT

Figure 9:
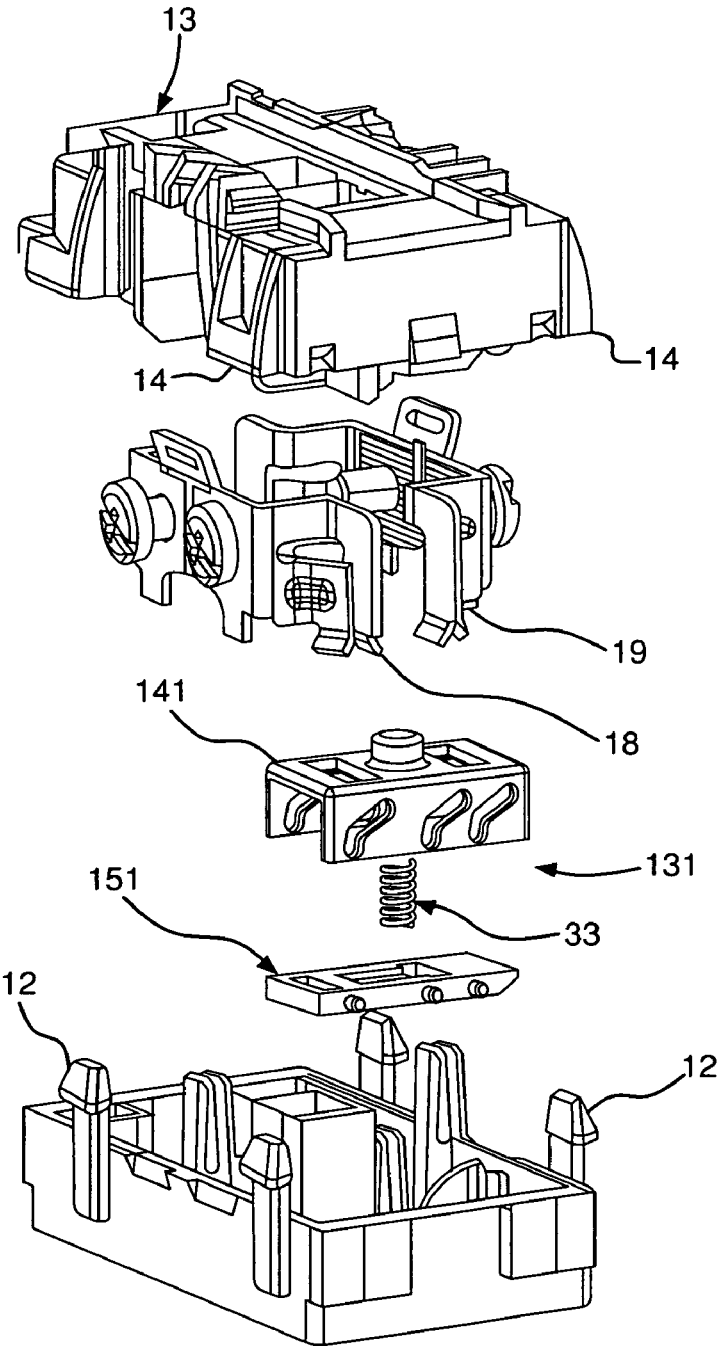
FIG. 9 is an exploded perspective view of the tamper resistant assembly of FIG. 8 and an electrical receptacle.

A second exemplary embodiment of the tamper resistant assembly is shown in FIGS. 8 and 9. The back housing 13, front cover 11, electrical contacts 18 and 19 and the spring 33 are substantially identical to those of the first exemplary embodiment described above.

The tamper resistant assembly 131 according to a second exemplary embodiment, as shown in FIGS. 8 and 9, includes a base member 141, a shutter member 151 and a spring 33. First, second and third grooves 143, 145 and 147 are formed in a first sidewall 140 of the base member 41, and fourth, fifth and sixth grooves 144, 146 and 148 are formed in a second sidewall 142 of the base member 141. A recess 149 in the rear wall 160 of the base member 141 receives the second end 36 of the spring 33. Each groove is substantially similar to the first and second grooves 43 and 44 described with regard to the first exemplary embodiment.

A shutter member 151 is slidably connected to the base member 141. First, second and third protrusions 153, 155 and 157 extend outwardly from a first side 150 of the shutter member 151 and are movably received in the first, second and third grooves 143, 145 and 147, respectively, in the base member 141. Fourth, fifth and sixth protrusions (not shown) extend outwardly from a second side 152 of the shutter member 151 and are movably received in the fourth, fifth and sixth grooves 144, 146 and 148, respectively, in the base member 141. Preferably, the protrusions are circular and cylindrical. An opening 152 in the shutter member 151 allows a plug blade 22 to pass therethrough in a manner similar to the shutter member 51 of the first exemplary embodiment shown in FIG. 7. A recess 159 in the lower surface 156 of the shutter member 151 receives the first end 34 of the spring 33.

Assembly and operation of the tamper resistant assembly 131 of the second exemplary embodiment shown in FIGS. 8 and 9 is substantially similar to that of the first exemplary embodiment described above and shown in FIGS. 1-7.

THIRD EXEMPLARY EMBODIMENT

A third exemplary embodiment of the tamper resistant assembly is shown in FIGS. 10-15. The back housing 13, front cover 11, electrical contacts 18 and 19 and the spring 33 are substantially identical to those of the first exemplary embodiment described above. The base member is substantially identical to the base member 141 of the second exemplary embodiment described above.

The tamper resistant assembly 231 according to a third exemplary embodiment, as shown in FIGS. 10-15, includes the base member 141 of the second exemplary embodiment, a shutter member 251 and a spring 33. The shutter member 251 is substantially similar to the shutter member 151 of the second exemplary embodiment with a second opening 263 in addition to the first opening 261.

Assembly and operation of the tamper resistant assembly 131 of the third exemplary embodiment shown in FIGS. 10-15 is substantially similar to that of the first exemplary embodiment described above and shown in FIGS. 1-7.

As plug blades 22 and 28 are inserted through first and second openings 21 and 23, respectively, as shown in FIGS. 12-15, the blades 22 and 28 contact the upper surface 252 of the shutter member 251. As the plug blades 22 and 28 contact the upper surface 252, the shutter member 251 is moved such that the openings 261 and 263 in the shutter member 251 are aligned with the first and second openings 124 and 126, respectively, in the base member 41. The pressure exerted on the opposite ends of the shutter member 251 causes the protrusions 253, 255 and 257 to move from the first portions 171 of the grooves 143, 145 and 147 to the second portions 173, thereby moving the shutter member 251 to an open position in which the plug blades 22 and 28 may access the electrical contacts 18 and 19. The protrusions are preferably circular and cylindrical. Thus, the shutter member 251 moves in two dimensions, upwardly and laterally, when moving from the closed to the open position. In the open position, the openings 261 and 263 in the shutter member 251 are aligned with the openings 124 and 126, respectively, in the base member 241 to provide access to the electrical contacts 18 and 19. Upon removal of the plug blades 22 and 28, the spring 33 causes the protrusions to move through the grooves 143, 145 and 147 to the first portions thereof, thereby returning the shutter member 251 to the closed position.

Figure 10:
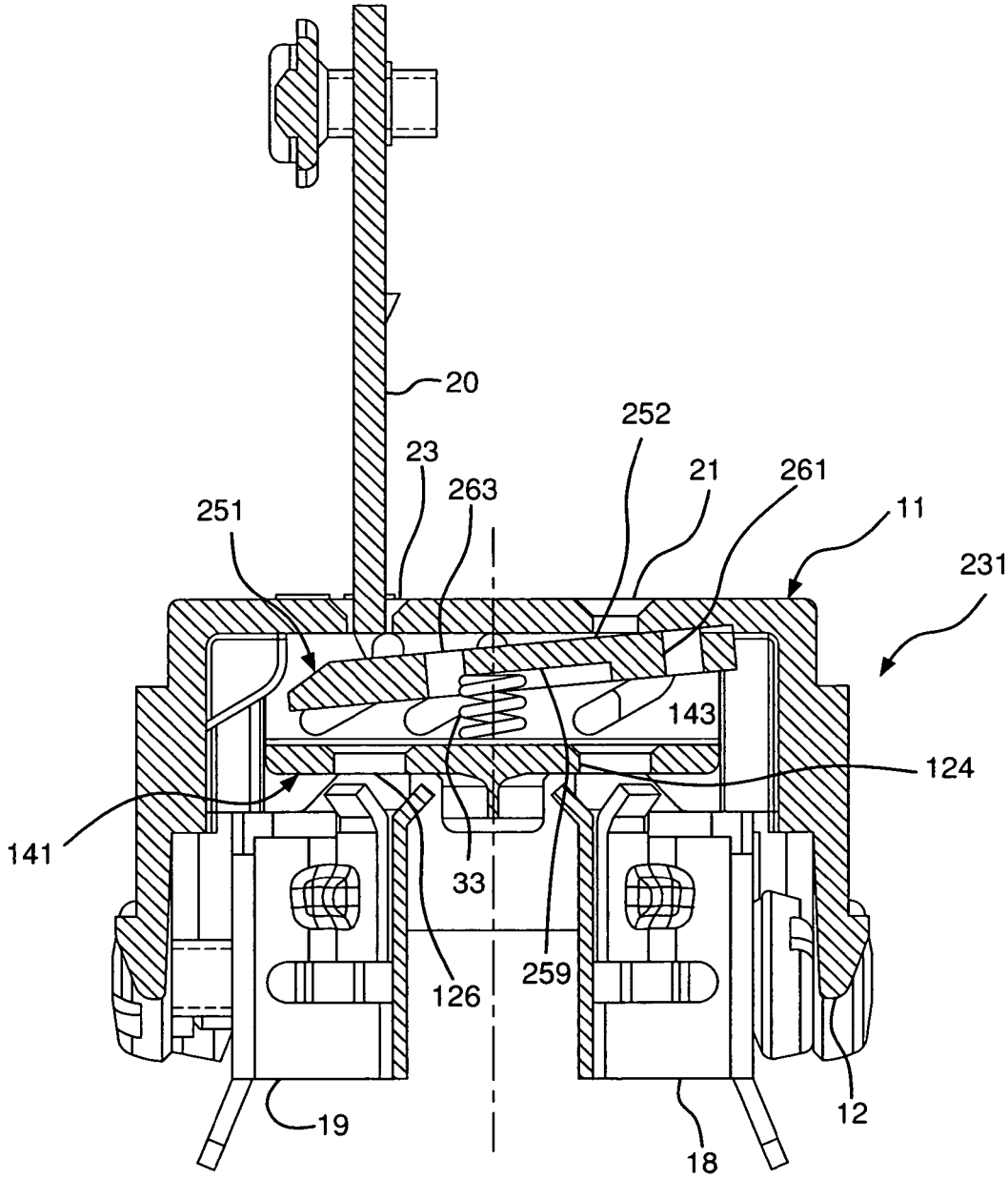
FIGS. 10 and 11 are end elevational views in cross section of the tamper resistant assembly of a third exemplary embodiment disposed in an electrical receptacle and blocking access to an electrical contact.
Figure 11:
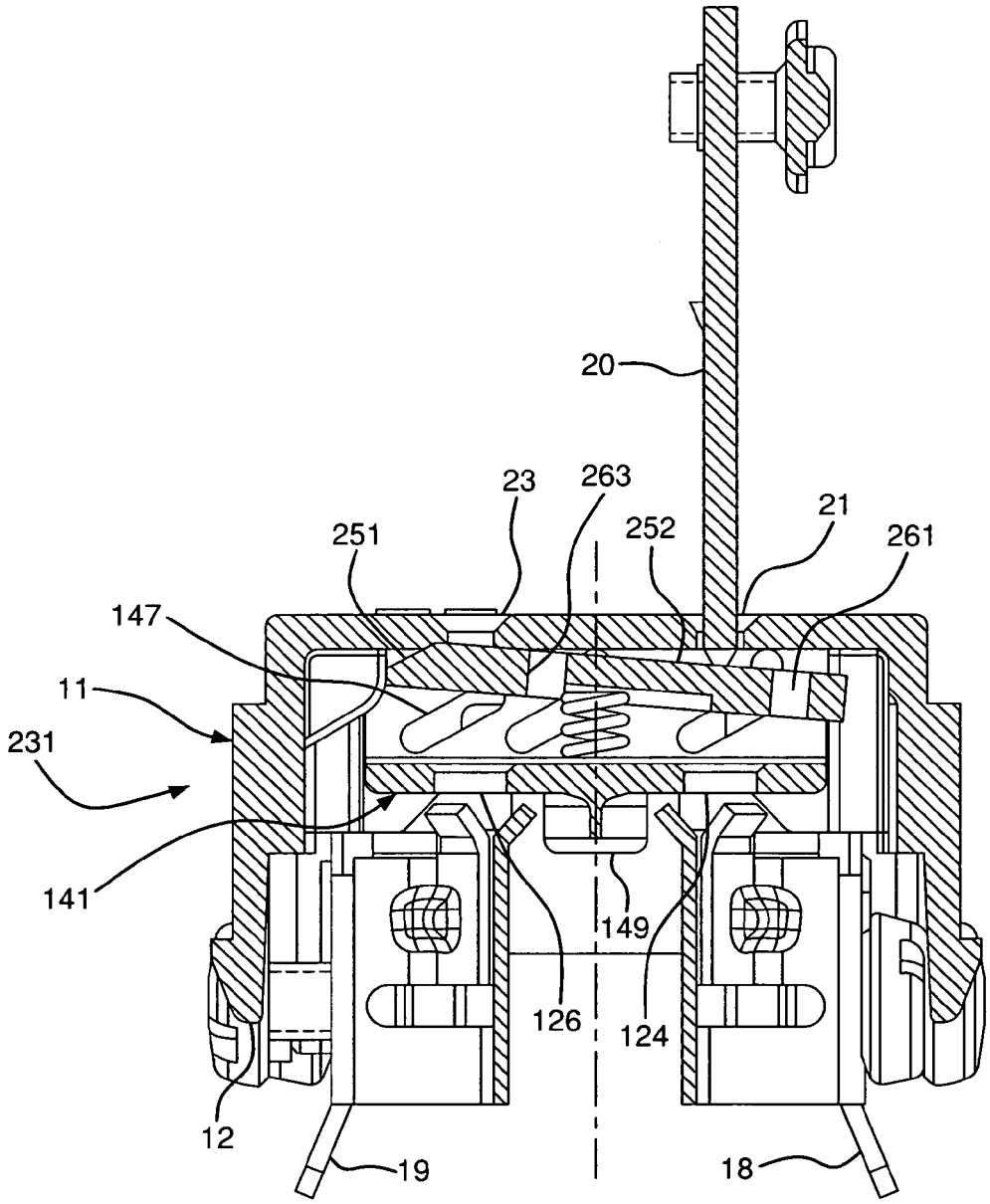
Figure 12:
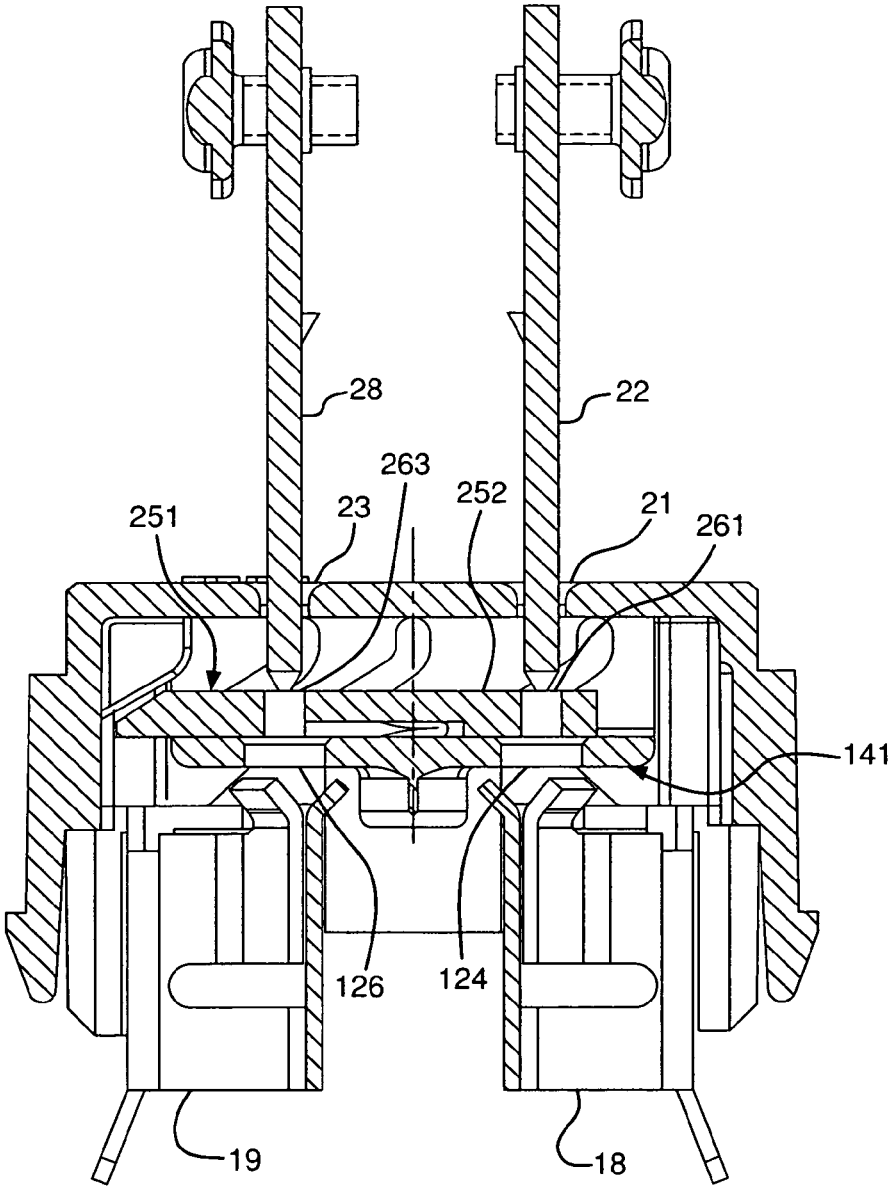
FIGS. 12 and 13 are end elevational views in cross section of the tamper resistant assembly of FIGS. 10 and 11 disposed in an electrical receptacle and allowing access to electrical contacts.
Figure 13:
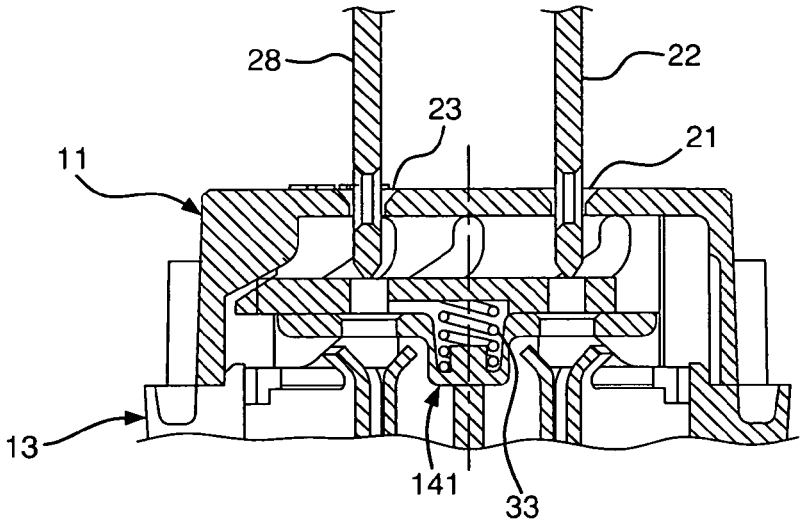
Figure 14:
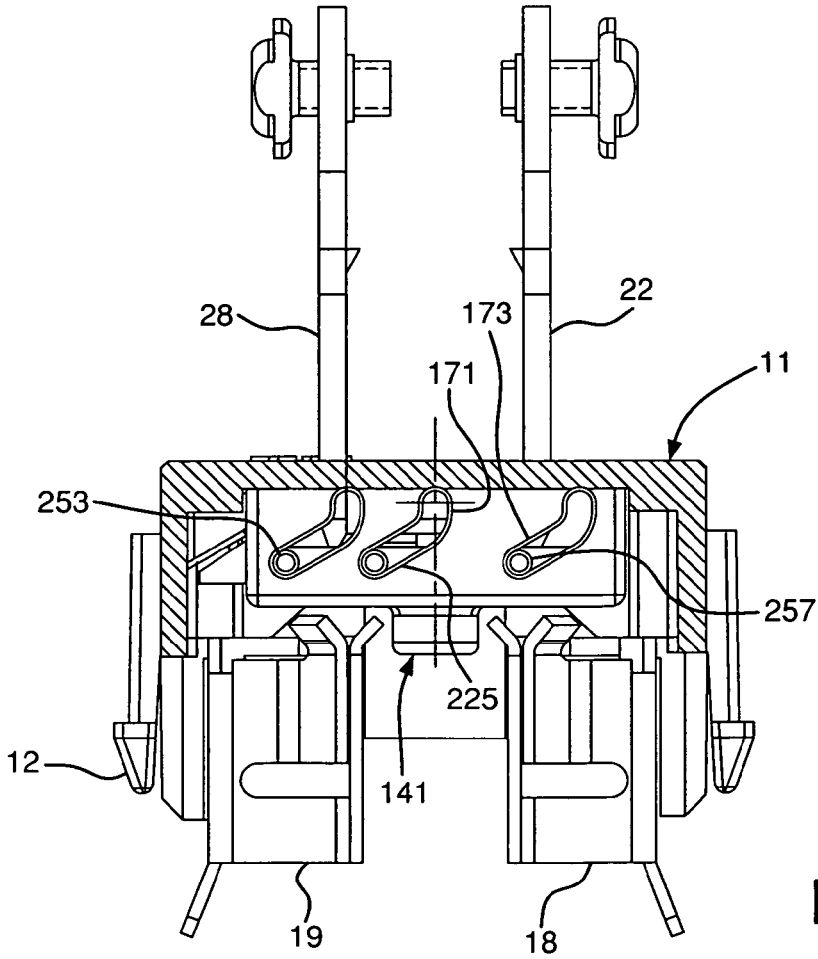
FIGS. 14 and 15 are end elevational views in partial cross section of the tamper resistant assembly of FIGS. 10 and 11 disposed in an electrical receptacle and allowing access to electrical contacts; and Throughout the drawings, like reference numerals will be understood to refer to like parts, components and structures.
Figure 15:
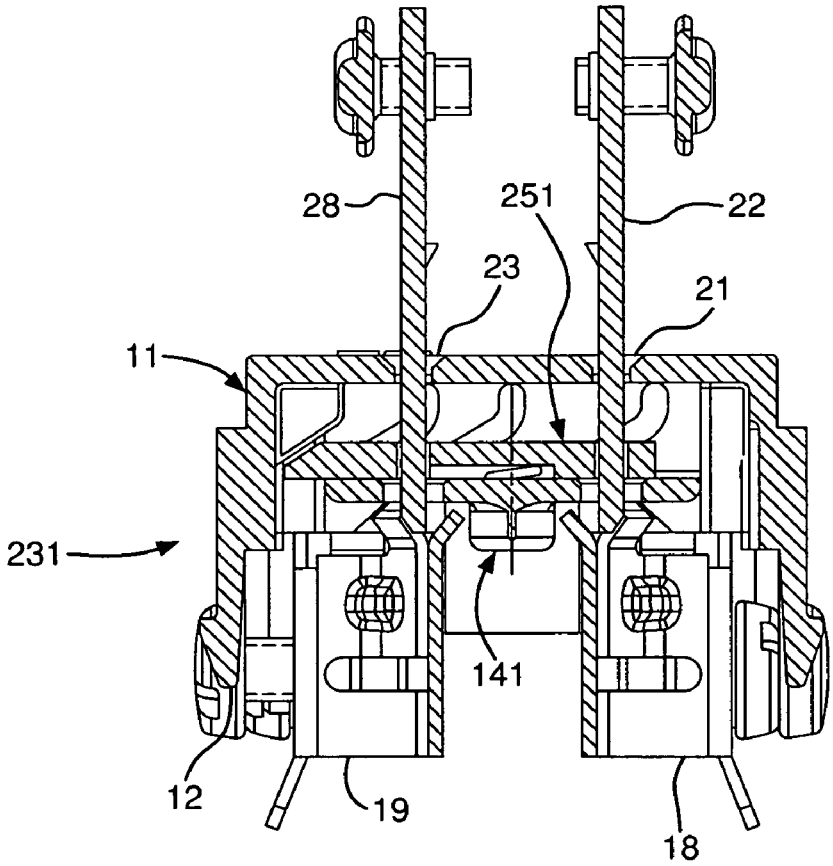

However, insertion of a foreign object 20, such as a single blade-like article, in either the first or second openings 21 and 23 is prevented from accessing the conductive elements 18 and 19 by the tamper resistant assembly 231, as shown in FIGS. 10 and 11. For example, as shown in FIG. 10, an object 20 inserted in the second opening 23 in the front cover 11 engages the upper surface 252 of the shutter member 251, thereby rotating the shutter member 251 about the protrusions such that the shutter member 251 remains in the closed position and access to the electrical contacts 18 and 19 is blocked. The rotation of the shutter member 251 causes the protrusion received in the groove 143 to move slightly upwardly such that the walls forming the first portion of the groove 143 prevent further downward movement of the shutter member 251 by the foreign object 20, thereby preventing lateral movement of the shutter member 251. Thus, as shown in FIG. 10, the opening 263 in the shutter member 251 is not aligned with the opening 126 in the base member 141, thereby preventing the foreign object from accessing the electrical contact 19.

Similarly, the foreign object 20 is also prevented from accessing the conductive element 18 when inserted in the first opening 21 in the front cover 11, as shown in FIG. 11. The object 20 inserted in the first opening 21 engages the upper surface 252 of the shutter member 251, thereby rotating the shutter member 251 about the protrusions such that the shutter member 251 remains in the closed position and access to the electrical contacts 18 and 19 is blocked. The rotation of the shutter member 251 causes the protrusion received in the groove 147 to move slightly upwardly such that the walls forming the first portion of the groove 147 prevent further downward movement of the shutter member 251 by the foreign object 20, thereby preventing lateral movement of the shutter member 251. Thus, as shown in FIG. 11, the opening 261 in the shutter member 251 is not aligned with the openings 124 in the base member 141, thereby preventing the foreign object 20 from accessing the electrical contact 18.

While various advantageous embodiments have been chosen to illustrate the invention, it will be understood by those skilled in the art that various changes and modifications may be made therein without departing from the scope of the invention as defined in the appended claims.

What is claimed is:

1. A tamper resistant assembly for an electrical receptacle, comprising:

a base member;

first and second grooves in said base member, each said groove having a first portion and a second portion connected to said first portion, said first portion being substantially perpendicular to a rear wall of said base member and said second portion forming an obtuse angle with said first portion;

a shutter member slidably and pivotally connected to said base member for movement between open and closed positions; and first and second protrusions extending outwardly from said shutter member and being slidably and pivotally received in said first and second grooves, respectively, in said base member, said first and second protrusions being disposed in said first portions of said grooves when said shutter member is in said closed position and preventing lateral sliding of said shutter member to prevent insertion of a foreign object past said shutter member and in said second portions when said shutter member is in said open position by allowing lateral sliding of said shutter member, said first portions preventing lateral movement of said shutter member and allowing pivoting movement of said shutter member to positions preventing insertion of the foreign object past said shutter member.

2. The tamper resistant assembly of claim 1, wherein said angle is approximately 128 degrees.

3. The tamper resistant assembly of claim 1, wherein when said shutter member has an opening therein for passage of a plug blade therethrough when in said open position.

4. The tamper resistant assembly of claim 1, wherein said shutter member has first and second openings therein for passage of first and second plug blades therethrough when in said open position.

5. The tamper resistant assembly of claim 1, wherein a spring is disposed between said shutter member and said base member to bias said shutter member away from said rear surface of said base member.

6. The tamper resistant assembly of claim 5, wherein a first end of said spring is received by a recess in said base member.

7. A tamper resistant assembly for an electrical receptacle, comprising:

a base member having first and second side walls extending forwardly from a rear wall;

first and second grooves in said first side wall of said base member and third and fourth grooves in said second side wall, each said groove having a first portion and a second portion connected to said first portion, said first portion being substantially perpendicular to said rear wall of said base member and said second portion forming an obtuse angle with said first portion;

a shutter member slidably and pivotally connected to said base member for movement between open and closed positions; and first and second protrusions extending outwardly from said shutter member and being slidably and pivotally received in said first and second grooves in said base member and third and fourth protrusions extending outwardly from said shutter member and being slidably and pivotally received in said third and fourth grooves, wherein said protrusions are disposed in said first portions of said grooves when said shutter member is in said closed position and preventing lateral sliding of said shutter member to prevent insertion of a foreign object past said shutter member and in said second portions when said shutter member is in said open position by allowing lateral sliding of said shutter member, said first portions preventing lateral movement of said shutter member and allowing pivoting movement of said shutter member to positions preventing insertion of the foreign object past said shutter member.

8. The tamper resistant assembly of claim 7, wherein said angle is approximately 128 degrees.

9. The tamper resistant assembly of claim 7, wherein when said shutter member has an opening therein for passage of a plug blade therethrough when in said open position.

10. The tamper resistant assembly of claim 7, wherein said shutter member has first and second openings therein for passage of first and second plug blades therethrough when in said open position.

11. The tamper resistant assembly of claim 7, wherein a spring is disposed between said shutter member and said base member to bias said shutter member away from said rear surface of said base member.

12. The tamper resistant assembly of claim 11, wherein a first end of said spring is received by a recess in said base member.

13. The tamper resistant assembly of claim 7, wherein said first and second protrusions are oppositely disposed on said shutter member from said third and fourth protrusions.

14. The tamper resistant assembly of claim 13, wherein fifth and sixth protrusions extend outwardly from said shutter member; and fifth and sixth grooves are formed in said first and second sidewalls, respectively, wherein said fifth protrusion is received in said fifth groove and said sixth protrusion is received in said sixth groove.

15. An electrical receptacle, comprising:

a front cover;

a back housing secured to said front cover;

a tamper resistant assembly disposed between the front cover and the back housing, including a base member having first and second side walls extending forwardly from a rear wall;

first and second grooves in said first side wall of said base member and third and fourth grooves in said second side wall, each said groove having a first portion and a second portion connected to said first portion, said first portion being substantially perpendicular to said rear wall of said base member and said second portion forming an obtuse angle with said first portion;

a shutter member slidably and pivotally connected to said base member for movement between open and closed positions; and first and second protrusions extending outwardly from said shutter member and being slidably and pivotally received in said first and second grooves in said base member and third and fourth protrusions extending outwardly from said shutter member and being slidably and pivotally received in said third and fourth grooves, wherein said protrusions are disposed in said first portions of said grooves when said shutter member is in said closed position and preventing lateral sliding of said shutter member to prevent insertion of a foreign object past said shutter member and in said second portions when said shutter member is in said open position by allowing lateral sliding of said shutter member, said first portions preventing lateral movement of said shutter member and allowing pivoting movement of said shutter member to positions preventing insertion of the foreign object past said shutter member.

16. The electrical receptacle of claim 15, wherein said tamper resistant assembly is snap fit in the front cover or the back housing.

17. The tamper resistant assembly of claim 15, wherein said angle is approximately 128 degrees.

18. The tamper resistant assembly of claim 15, wherein when said shutter member has an opening therein for passage of a plug blade therethrough when in said open position.

19. The tamper resistant assembly of claim 15, wherein a spring is disposed between said shutter member and said base member to bias said shutter member away from said rear surface of said base member.

20. The tamper resistant assembly of claim 19, wherein a first end of said spring is received by a recess in said base member.

* * * * *